US008804991B2

(12) United States Patent
Velican

(10) Patent No.: US 8,804,991 B2
(45) Date of Patent: Aug. 12, 2014

(54) LOUDSPEAKER ASSEMBLY AND SYSTEM

(75) Inventor: Zeljko Velican, Endeavour Hills (AU)

(73) Assignee: Blueprint Acoustics Pty Ltd (AU)

( * ) Notice: Subject to any disclaimer, the term of this patent is extended or adjusted under 35 U.S.C. 154(b) by 142 days.

(21) Appl. No.: 13/503,531

(22) PCT Filed: Oct. 22, 2010

(86) PCT No.: PCT/AU2010/001405

§ 371 (c)(1),
(2), (4) Date: May 17, 2012

(87) PCT Pub. No.: WO2011/047435

PCT Pub. Date: Apr. 28, 2011

(65) Prior Publication Data

US 2012/0219171 A1 Aug. 30, 2012

(30) Foreign Application Priority Data

Oct. 23, 2009 (AU) ..... 2009905165

(51) Int. Cl.
*H04R 1/20* (2006.01)
*H04R 1/22* (2006.01)
*H04R 1/28* (2006.01)

(52) U.S. Cl.
CPC ..... *H04R 1/22* (2013.01); *H04R 1/2842* (2013.01); *H04R 2201/021* (2013.01); *H04R 2201/34* (2013.01); *H04R 2400/11* (2013.01); *H04R 2499/13* (2013.01)
USPC ..... 381/353; 381/345

(58) Field of Classification Search
CPC .. H02R 1/22; H02R 1/2842; H02R 2201/021; H02R 2201/34; H02R 2400/11; H02R 2499/13
USPC ..... 381/335, 89, 337, 338, 345, 351, 346, 381/349, 350, 389, 353; 181/156, 157, 160, 181/198, 199, 148, 155
See application file for complete search history.

(56) References Cited

U.S. PATENT DOCUMENTS

| | | | |
|---|---|---|---|
| 7,103,193 | B2 | 9/2006 | Croft, III |
| 2005/0094829 | A1 | 5/2005 | Cordell |
| 2006/0050915 | A1 | 3/2006 | Velican et al. |
| 2006/0219474 | A1 | 10/2006 | Goh et al. |

OTHER PUBLICATIONS

International Search Report from PCT/AU2010/001405, dated Jan. 7, 2011.

*Primary Examiner* — Tuan D Nguyen
(74) *Attorney, Agent, or Firm* — Lerner, David, Littenberg, Krumholz & Mentlik, LLP

(57) ABSTRACT

A loudspeaker assembly is disclosed for use in a loudspeaker system having infinite baffle topology. The assembly comprises a driver including a cone and a basket and at least one Helmholtz resonator including a chamber and a vent duct communicating with the chamber and adapted to pass through the infinite baffle. The chamber is dimensioned to provide a tuned frequency well above an operating band associated with the driver. The cross sectional area and length of the vent duct may be set to provide control over duct air noise and low frequency extension. A method of tuning a loudspeaker assembly for use in a loudspeaker system having infinite baffle topology is also disclosed.

19 Claims, 7 Drawing Sheets

LOUDSPEAKER ASSEMBLY AND SYSTEM

CROSS REFERENCE TO RELATED APPLICATIONS

The present application is a national phase entry under 35 USC §371 of International Application No. PCT/AU2010/001405, filed Oct. 22, 2010, which claims the benefit of and priority to Australian Patent Application No. 2009905165, filed Oct. 23, 2009, the entire disclosures of which are incorporated herein by reference.

FIELD OF THE INVENTION

The present invention relates to a loudspeaker assembly suitable for use in a loudspeaker system. The assembly is particularly suited to loudspeaker systems having infinite baffle topology operating below 300 Hz and in particular to systems that include a Helmholtz resonator.

BACKGROUND OF THE INVENTION

Helmholtz resonators are added to loudspeakers for three main reasons:

(i) to provide extension at low frequency by tuning at or near a bottom end of an operating band associated with a loudspeaker driver;

(ii) to provide acoustic filtering by tuning at or near a top end of the operating band; and (iii) to create cone minima in the operating or pass band.

In each case the physical form of the resonator is easily recognizable as a chamber containing a volume of air and a vent duct. The present invention may make use of a Helmholtz resonator for an entirely different reason and in a form that may be distinctly different to Helmholtz resonators of the prior art.

The present invention is suited to a loudspeaker system having infinite baffle topology. Although the term "infinite" is used to describe baffles they are not literally infinite, but rather are very large in effect. For example the walls, ceiling or floor of a room, or the roof, walls or floor of a vehicle may be regarded as infinite baffles for practical purposes.

One potential problem associated with application of infinite baffle topology to loudspeakers in vehicles is structural weakening. For example cutting large holes, such as for a 12 inch loudspeaker driver in any part of a vehicle may cause structural weakening.

One known way around this problem is to mount the loudspeaker driver in a separate box and to channel sound to a listening environment through a much smaller opening.

There are several known ways of doing this. One way is via suitably designed waveguides. Another way is to use a vent duct associated with a Helmholtz resonator to penetrate a rear parcel shelf or deck of a vehicle to channel the sound to the listening environment.

Known Helmholtz resonators used to penetrate parcel shelves in vehicles are tuned in traditional ways to create band pass alignments and/or to extend low frequency response and/or to create cone minima in the pass band as described above. When used in these ways prior art infinite baffle topology loudspeaker systems using Helmholtz resonators are inherently large. Infinite baffle topology loudspeakers without Helmholtz resonators roll off at a low end of their operating band with a similar cut off frequency to sealed box topology loudspeakers. This arrangement cannot provide low frequency extension.

The present invention may provide a loudspeaker assembly comprising an electro-acoustic transducer or driver and at least one Helmholtz resonator suitable for use in a loudspeaker system. The loudspeaker assembly may be relatively small in size and may have a relatively high sensitivity. It may also have a relatively very low cut off frequency compared to sealed box topology for a same or similar driver.

Prior art teaches that low frequency extension is achieved by tuning low, near the desired low frequency cut off. It is counter intuitive in prior art that low frequency extension could be achieved by tuning higher, above the operating band of the loudspeaker assembly.

Tuning higher to provide low frequency extension would have an advantage that the loudspeaker assembly may be very small. The loudspeaker may be made as small as desired to satisfy practical requirements including cost and space availability. In some applications it may be appropriate to make the loudspeaker assembly even smaller to achieve a desired response.

Reactive components of a loudspeaker system comprising a driver mounted in a baffle may be modelled as a parallel resonant circuit. Reactive components of a Helmholtz resonator may be modelled as a series resonant circuit. When a Helmholtz resonator is added to a loudspeaker driver mounted in a baffle the components of the series resonant circuit interact with the components of the parallel resonant circuit to produce:

a) a lower tuned frequency which determines a low frequency roll off commonly called the "low cut off frequency";

b) an intermediate tuned frequency commonly called the "box tuning" or "port tuning"; and c) an upper tuned frequency which determines a high frequency roll off.

For avoidance of doubt a reference to a frequency well above an operating band is a reference to the upper tuned frequency.

A reference herein to a patent document or other matter which is given as prior art is not to be taken as an admission that that document or matter was, in Australia, known or that the information it contains was part of the common general knowledge as at the priority date of any of the claims.

Throughout the description and claims of this specification, the word "comprise" and variations of the word, such as "comprising" and comprises", is not intended to exclude other additives or components or integers.

SUMMARY OF THE INVENTION

According to one aspect of the present invention there is provided a loudspeaker assembly suitable for use in a loudspeaker system having infinite baffle topology, said assembly comprising a driver including a cone and a basket and at least one Helmholtz resonator including a chamber and a vent duct communicating with said chamber and adapted to pass through said infinite baffle, wherein said chamber is dimensioned to provide a tuned frequency well above an operating band associated with said driver.

The volume of the chamber may be dimensioned so that it is relatively compact or miniature relative to a chamber that is dimensioned to provide a tuned frequency within or close to the operating band associated with the driver. For example a 20 cm driver may be associated with a Helmholtz resonator including a chamber volume that may be between marginally above zero volume to substantially 3 liters.

The cross sectional area of the vent duct may be set to minimize air noise in the vent duct and length of the vent duct may be set to control low frequency extension.

The loudspeaker assembly may include two Helmholtz resonators wherein one resonator is positioned on each side of the driver.

In some embodiments the assembly may be adapted for use in a motor vehicle. The infinite baffle may include a perimeter of a passenger compartment of the vehicle and the duct may be adapted to pass through the perimeter. The infinite baffle may include an outer skin of the vehicle and the duct may be adapted to pass through the outer skin. The duct may be adapted to pass through an existing opening in the skin such as a ventilation port.

The frequency response of an associated loudspeaker system may be rolled off at or near a top end of the operating band by means other than a Helmholtz resonator.

In a limiting case the chamber of at least one Helmholtz resonator may approach zero volume except for air trapped in an excursion range or swept volume associated with the cone.

The present invention may provide a composite loudspeaker assembly including at least one loudspeaker assembly as described above wherein the composite assembly is arranged such that it is acoustically symmetrical. The composite assembly may include two substantially identical loudspeaker assemblies arranged face to face and adapted to be driven as an isobaric pair.

According to a further aspect of the present invention there is provided a loudspeaker assembly suitable for use in a loudspeaker system having infinite baffle topology, said assembly comprising a driver including a cone and a basket wherein said basket includes a substantially continuous barrier to trap air behind said cone in a rear chamber formed by said barrier and said cone, said rear chamber being vented by a vent duct in said basket.

The loudspeaker assembly may include a further barrier for trapping air in front of the cone in a front chamber formed by the further barrier and the cone. The front chamber may be vented by a further vent duct in the further barrier.

The present invention may provide a composite loudspeaker assembly including two loudspeaker assemblies arranged face to face with a sealed space there between, wherein each loudspeaker assembly is constructed with air trapped in a rear chamber as described above and is adapted to operate as an isobaric pair.

According to a further aspect of the present invention there is provided a loudspeaker assembly suitable for use in a loudspeaker system having infinite baffle topology, said assembly comprising a driver including a cone and a basket wherein said driver includes a substantially continuous barrier for trapping air in front of said cone in a front chamber formed by said barrier and said cone, said front chamber being vented by a vent duct in said continuous barrier.

The present invention may provide a composite loudspeaker assembly including two loudspeaker assemblies arranged back to back, wherein each loudspeaker assembly is constructed as described above and the composite assembly is adapted to operate as an isobaric pair.

According to a further aspect of the present invention there is provided a method of tuning a loudspeaker assembly for use in a loudspeaker system having infinite baffle topology, said assembly including a driver having a cone and a basket, and at least one Helmholtz resonator having a chamber and a vent duct communicating with said chamber and adapted to pass through said infinite baffle, said method comprising dimensioning said chamber to provide a tuned frequency well above an operating band associated with said driver.

The method may include setting cross sectional area of the vent duct to minimize air noise in the vent duct and setting length of the vent duct to control low frequency extension.

A loudspeaker assembly according to the present invention may be fabricated from prior art components. Alternatively it may be manufactured in a form of a driver with one or more inbuilt Helmholtz resonators.

The present invention may allow a loudspeaker assembly to be installed in an infinite baffle regardless of noise, dust, mud, water and/or other environmental conditions including on a side of a baffle opposite a listening environment by orienting an aperture of a vent to that side of the baffle. Shielding from noise, dust and the like may be provided as required.

DESCRIPTION OF THE DRAWINGS

Preferred embodiments of the present invention will now be described with reference to the accompanying drawings wherein.

DETAILED DESCRIPTION OF THE INVENTION

Figure 1:
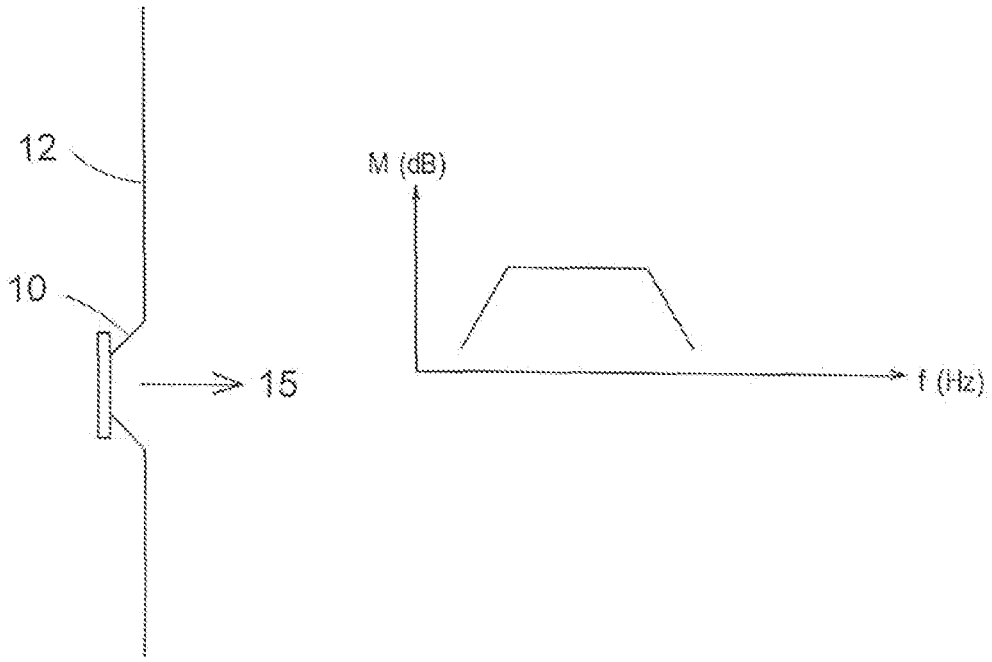
PRIOR ART Fig 1
FIG. 1 shows a schematic representation of a typical prior art infinite baffle topology loudspeaker system without a Helmholtz resonator.

A known method of constructing an infinite baffle topology loudspeaker system is simply to mount a loudspeaker driver directly to an infinite baffle as shown in FIG. 1. In FIG. 1 loudspeaker driver 10 is mounted to infinite baffle 12 and radiates sound to a listening environment 15. FIG. 1 also shows a frequency response graph including a roll off at each end of an operating band associated with driver 10. Roll off at the high end may be achieved by electrical means. Low frequency roll off is a consequence of driver parameters. Driver 10 in FIG. 1 is shown facing forwards towards the listening environment 15. This is a common prior art arrangement because it does not project into the listening environment 15. A disadvantage of this particular topology is that the response cannot be adjusted for low frequency extension.

Figure 2:
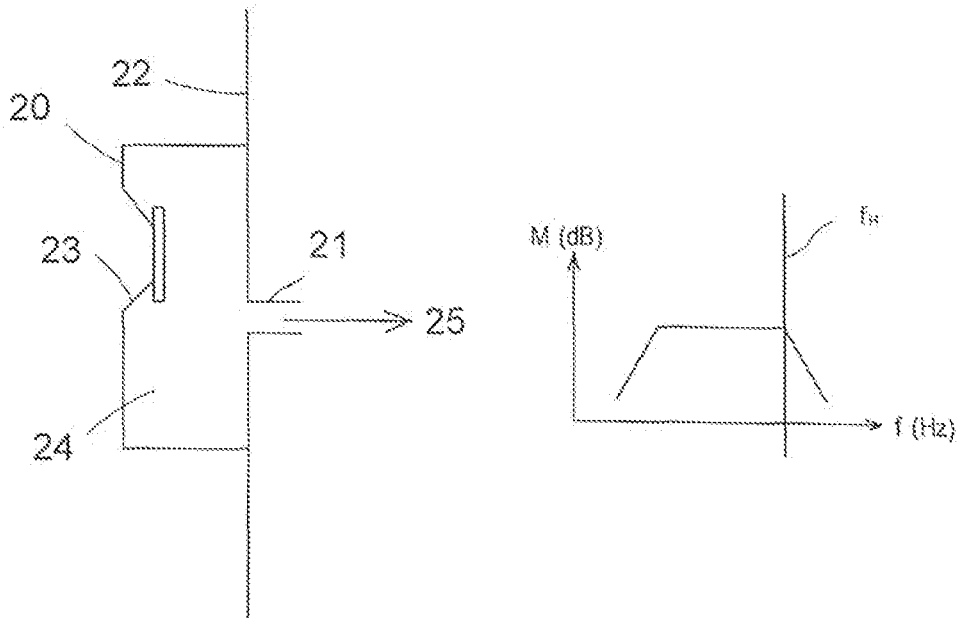
PRIOR ART Fig 2
FIG. 2 shows a schematic representation of a typical prior art infinite baffle topology loudspeaker system incorporating a Helmholtz resonator with tuning at a high end of an operating band.

One known means of adjustment is to add a Helmholtz resonator. A typical prior art infinite baffle topology loudspeaker with a Helmholtz resonator is shown in FIG. 2. In FIG. 2 chamber 20 in combination with vent duct 21 are mounted to infinite baffle 22 to form the Helmholtz resonator.

Loudspeaker driver 23 is mounted in chamber 20 containing air volume 24 and is vented via vent duct 21 to listening environment 25. Vent duct 21 penetrates infinite baffle 22 which has an advantage in that only a small hole is required in baffle 22.

Prior art Helmholtz resonators as shown in FIG. 2 are typically tuned to roll off at $f_H$, being at the high end of the operating band associated with driver 23, as shown on the frequency response graph in FIG. 2 to create an acoustic band-pass structure. Chamber 20 is typically much larger than driver 23. Note that the operating band in the graph in FIG. 2 is defined by a roll off at each end.

Figure 3:
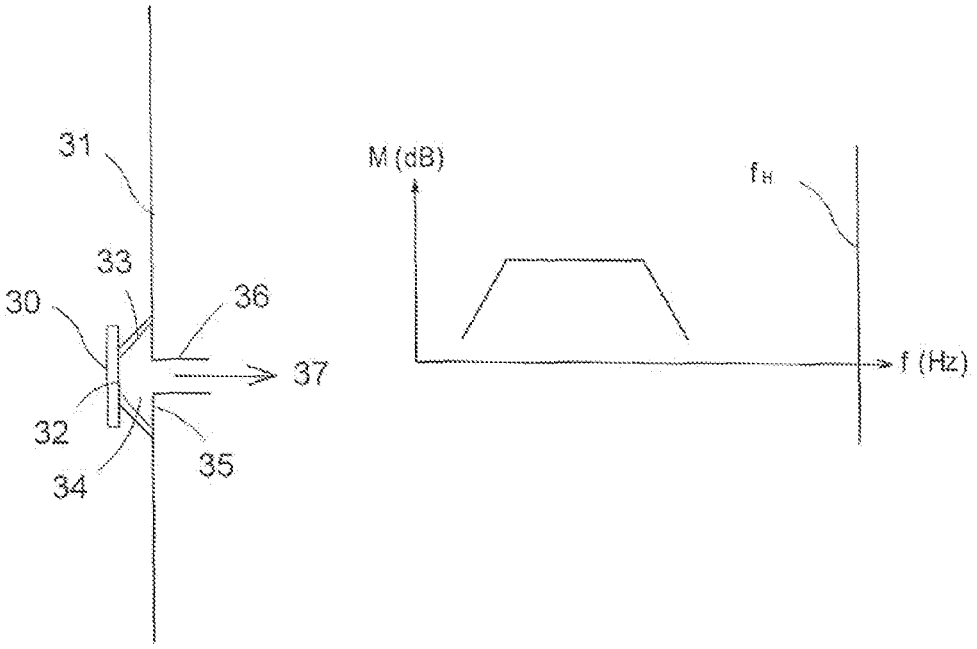
FIG. 3 shows a schematic representation of an infinite baffle topology loudspeaker system using a single Helmholtz resonator according to one embodiment of the present invention.

FIG. 3 shows loudspeaker driver 30 mounted to infinite baffle 31. In FIG. 3 chamber 32 is formed by cone 33 of driver 30 enclosing small air volume 34 between itself and front wall 35. Chamber 32 is vented by vent duct 36 which passes through infinite baffle 31 and radiates sound to listening environment 37. Chamber 32 and vent duct 36 form a Helmholtz resonator. Also shown in FIG. 3 is an associated frequency response graph showing roll off at both ends of the operating band associated with driver 30 with the Helmholtz resonator tuned high to produce a roll off at $f_H$ being well above the operating band.

Tuning of the Helmholtz resonator to produce a roll off well above the operating band is achieved by making chamber 32 substantially smaller than prior art Helmholtz chambers used in infinite baffle topology loudspeakers for low frequency applications. Chamber 32 may typically be similar in size to driver 30. In the example of FIG. 3 chamber 32 is smaller in volume than driver 30. In practical applications chamber 32 may range from zero volume up to several times the volume of driver 30 so long as the Helmholtz resonator is tuned to produce a roll off well above the operating band.

Figure 4:
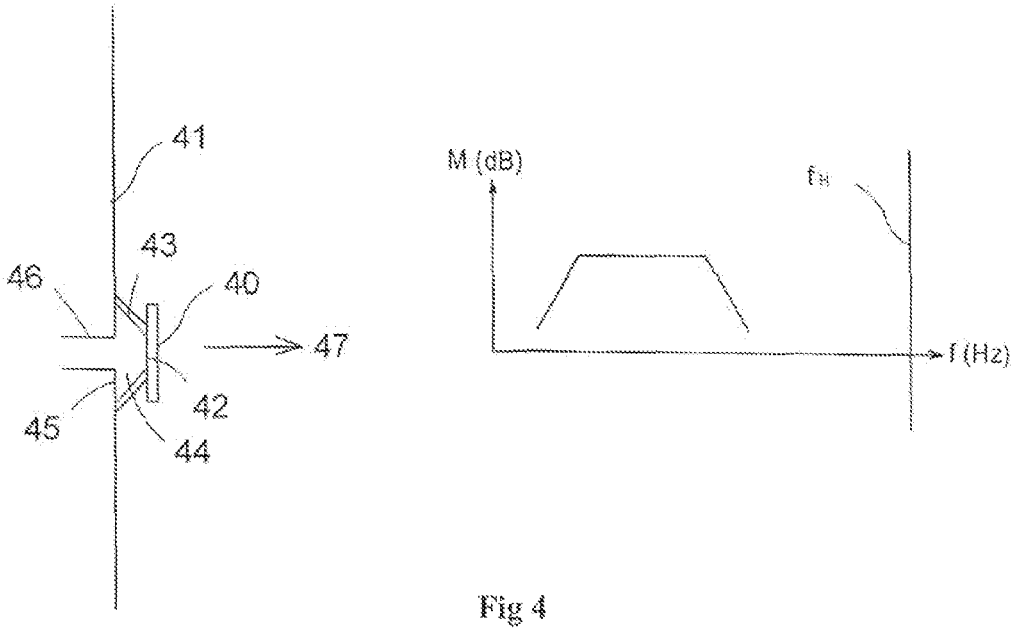
FIG. 4 shows a schematic representation of an infinite baffle topology loudspeaker system using a single Helmholtz resonator according to an alternative embodiment of the present invention.

It is preferable to orientate the loudspeaker system such that vent duct 36 radiates sound to listening environment 37 as shown in FIG. 3. However it is also possible to reverse the orientation as shown in FIG. 4. The elements shown in FIG. 4 are similar to FIG. 3 although the prefix 3 designating each element is changed to a 4. For example baffle 31 in FIG. 3 becomes baffle 41 in FIG. 4. In FIG. 4 driver 40 radiates sound to the listening environment 47 from the back of the cone. However this is not a preferred embodiment for most applications in part because the response of such an arrangement is far from ideal.

Figure 5:
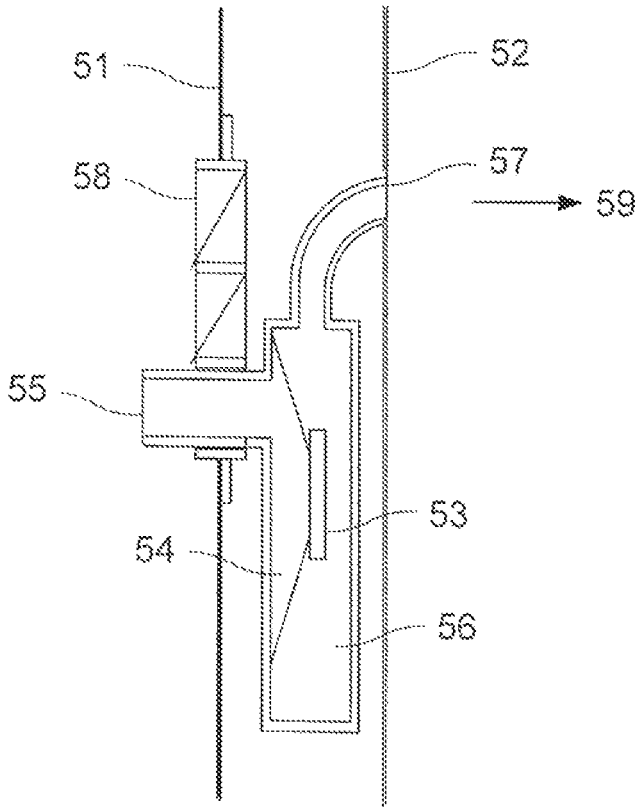
FIG. 5 shows a schematic representation of an infinite baffle topology loudspeaker system using two Helmholtz resonators situated in a vehicle according to an embodiment of the present invention.

FIG. 5 shows a practical arrangement of an infinite baffle topology loudspeaker system situated in a wall of a vehicle including outer skin 51 and lining 52. Loudspeaker driver 53 is enhanced with (a) a front Helmholtz resonator including small air volume chamber 54 resonating with vent duct 55 to provide tuning well above the operating band of driver 53 and (b) a rear Helmholtz resonator including small air volume chamber 56 resonating with vent duct 57 to provide tuning also well above the operating band of driver 53.

The relatively small Helmholtz resonator chambers 54, 56 enable the loudspeaker system to be placed in locations that may be impractical for infinite baffle topology loudspeakers using prior art Helmholtz resonator alignments. In FIG. 5, vent duct 55 is shown penetrating outer skin 51 of the vehicle via ventilation port 58, while vent duct 57 penetrates vehicle lining 52 to radiate sound to a listening environment 59 inside the vehicle.

Manufacturers may find value in being able to use existing openings in the skin of a vehicle. Alternatively if there are no existing openings in desired locations additional openings may be provided. In a preferred embodiment a vent duct may penetrate the outer skin of a vehicle, but performance may be traded for cost saving by penetrating a rear parcel shelf, deck or fire wall of the vehicle.

In other examples the infinite baffle topology loudspeaker of the present invention may be installed in a wall, ceiling, roof or floor of a building.

Figure 6:
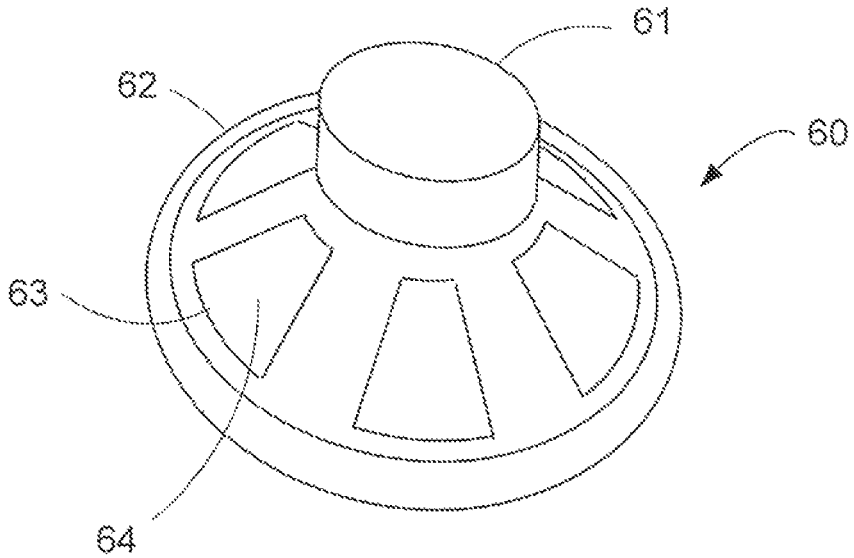
PRIOR ART Fig 6
FIG. 6 shows a typical prior art loudspeaker driver.

FIG. 6 shows a prior art loudspeaker driver 60 comprising a magnet 61, a basket 62, vent holes 63 in basket 62 allowing air to flow through in response to cone movement, and a small volume of air 64 between basket 62 and the cone of driver 60.

Figure 7:
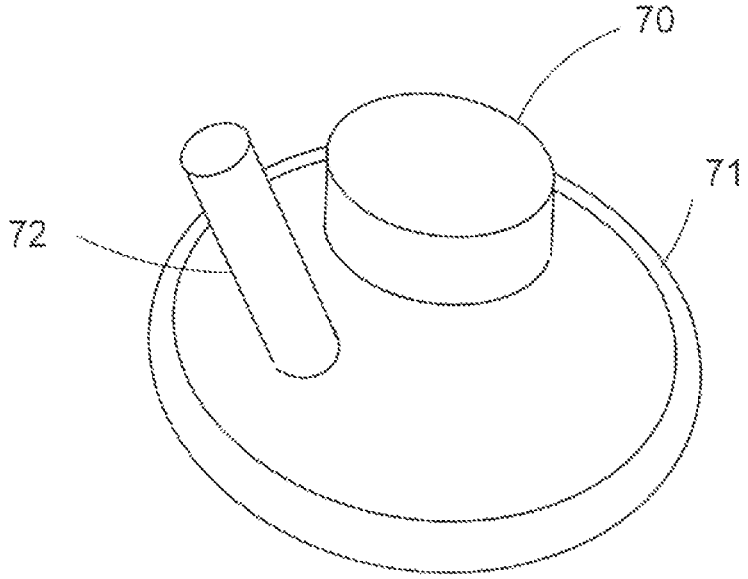
FIG. 7 shows a loudspeaker assembly with a Helmholtz resonator on a rear side thereof according to an embodiment of the present invention.

Since the volume of air required for a Helmholtz resonator according to the present invention may be relatively small, a loudspeaker assembly 70 as shown in FIG. 7 may be constructed wherein vent holes 63 as seen in FIG. 6 are not provided. Instead basket 71 is enclosed except for a vent duct 72. The volume between basket 71 and the cone of assembly 70 form a Helmholtz resonator together with vent duct 72.

Figure 8:
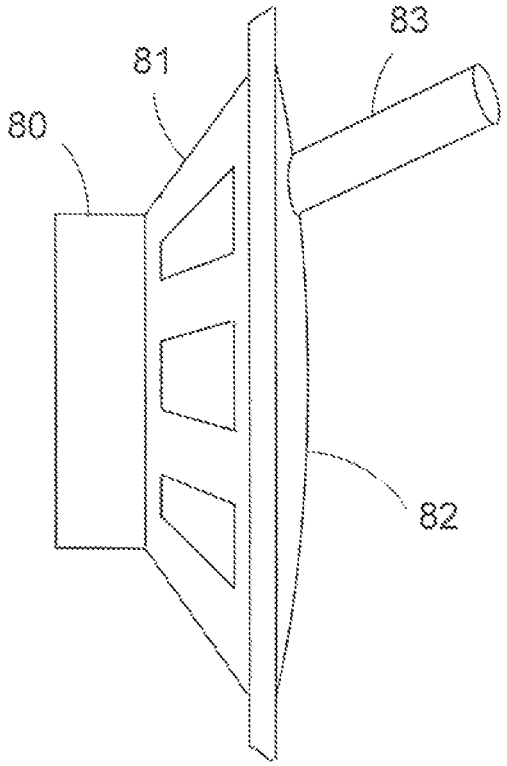
FIG. 8 shows a loudspeaker assembly with a Helmholtz resonator on a front thereof according to an embodiment of the present invention.

Alternatively a loudspeaker driver 80 including basket 81 may be enclosed at the front as shown in FIG. 8 by wall 82 forming a small cavity vented by vent duct 83 to create a loudspeaker assembly according to the present invention.

In each example the Helmholtz resonator may result in a high frequency roll off well above the intended operating band of the driver 70, 80 due to the small enclosed air volumes. The cross sectional area of the associated vent ducts 72, 83 may be varied to minimize duct air noise and the length of the vent ducts may be varied to set a desired low frequency extension.

Figure 9:
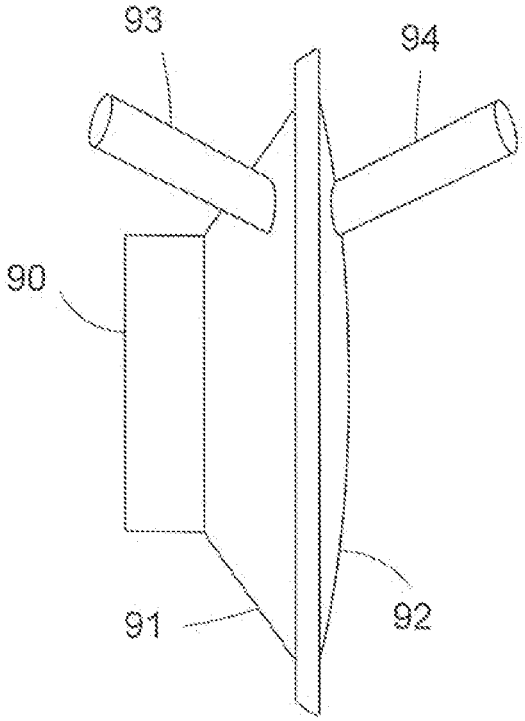
FIG. 9 shows a loudspeaker assembly with Helmholtz resonators on both sides thereof according to an embodiment of the present invention.

FIG. 9 shows an enhanced version of a loudspeaker assembly for use in infinite baffle topology applications according to the present invention. Driver 90 in FIG. 9 includes a Helmholtz resonator on each side of driver 90. Basket 91 of driver 90 is enclosed except for vent duct 93 and the front of driver 90 is enclosed by wall 92 except for vent duct 94. In a preferred embodiment the Helmholtz resonators so formed may produce a high frequency resonance at the same frequency which is well above the intended operating band of driver 90.

Figure 10:
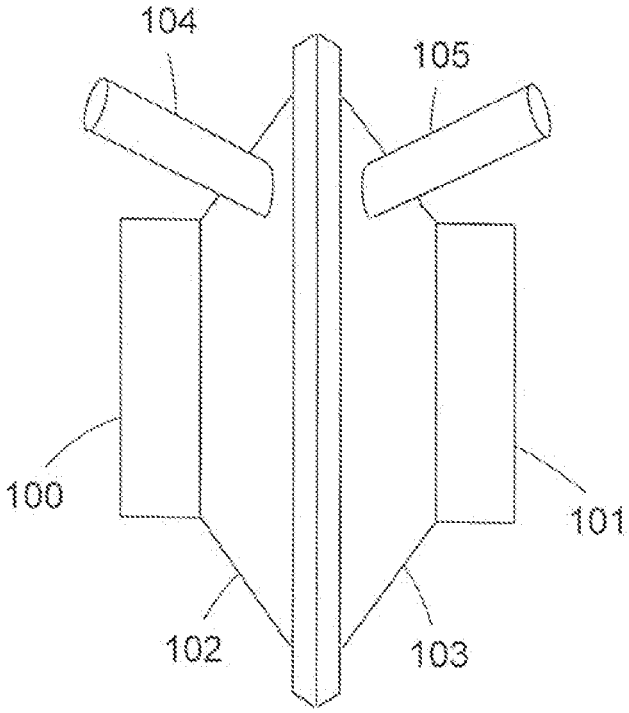
FIG. 10 shows a composite loudspeaker assembly with Helmholtz resonators on both sides thereof according to an embodiment of the present invention.

FIG. 10 shows a symmetrical version of a composite loudspeaker assembly according to the present invention wherein the composite assembly is formed from two loudspeaker assemblies arranged face to face so that their cones trap a volume of air between them. Each loudspeaker assembly has its respective basket 102 and 103 enclosed except for vent ducts 104 and 105. Motor assemblies 100 and 101 of the loudspeaker assemblies may typically be wired out of phase so that their cones move in the same direction. The cavity between the cones forms a dead volume that operates as an isobaric chamber.

Figure 11:
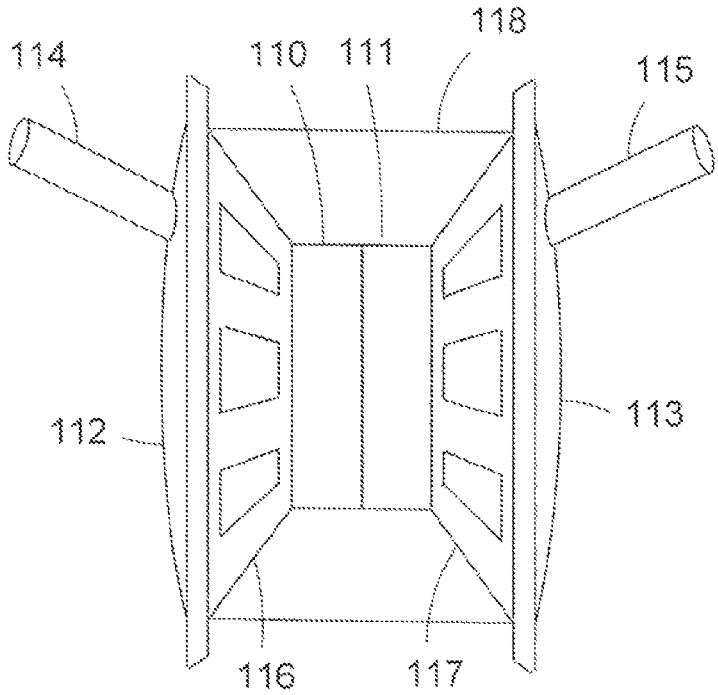
FIG. 11 shows a composite loudspeaker assembly with Helmholtz resonators on both sides thereof according to an embodiment of the present invention.

FIG. 11 shows an alternative symmetrical version of a composite loudspeaker assembly according to the present invention wherein two loudspeaker assemblies are arranged back to back with magnets 110 and 111 facing each other and potentially butting together. The fronts of loudspeaker assemblies 110,111 are enclosed by respective walls 112 and 113 except for vent ducts 114 and 115. Associated baskets 116, 117 and motor assemblies are housed in a cylindrical enclosure 118 shown cut away in FIG. 11. The associated motor assemblies may be wired out of phase so that cylindrical enclosure 118 operates as an isobaric chamber.

Figure 12:
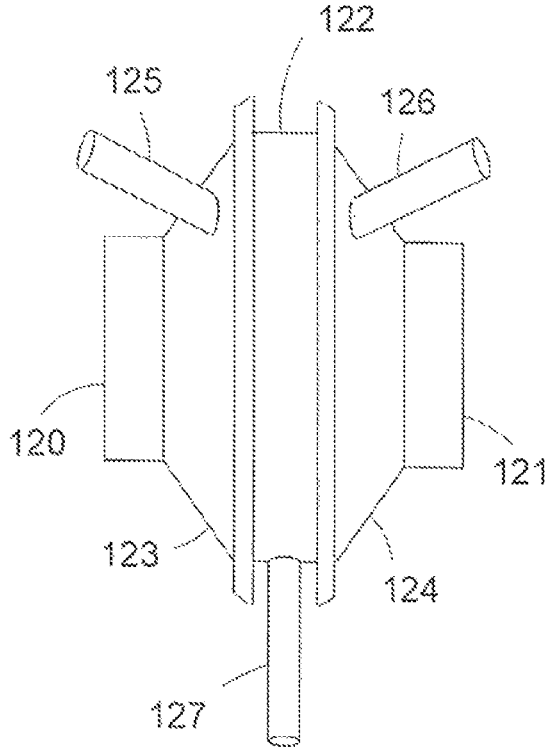
FIG. 12 shows a mechanically balanced composite loudspeaker assembly with Helmholtz resonators on both sides and a Helmholtz resonator in the centre thereof according to an embodiment of the present invention.

FIG. 12 shows a further enhancement of a composite loudspeaker assembly according to the present invention wherein two loudspeaker assemblies 120, 121 are arranged face to face and are joined by cylindrical enclosure 122. The baskets 123, 124 of loudspeaker assemblies 120, 121 are enclosed except for vent ducts 125, 126 to form Helmholtz resonators. Cylindrical enclosure 122 joining loudspeaker assemblies 120, 121 is vented by vent duct 127 to a listening environment and forms a third Helmholtz resonator.

In the above example motor assemblies associated with loudspeaker assemblies 120, 121 may typically be wired in phase (not isobaric) to provide mechanically balanced operation with minimal vibration. Each Helmholtz resonator may be tuned to produce a resonant frequency that is well above the intended operating band of the composite loudspeaker assembly. In a preferred embodiment each Helmholtz resonator may be tuned to produce the same resonant frequency.

Figure 13:
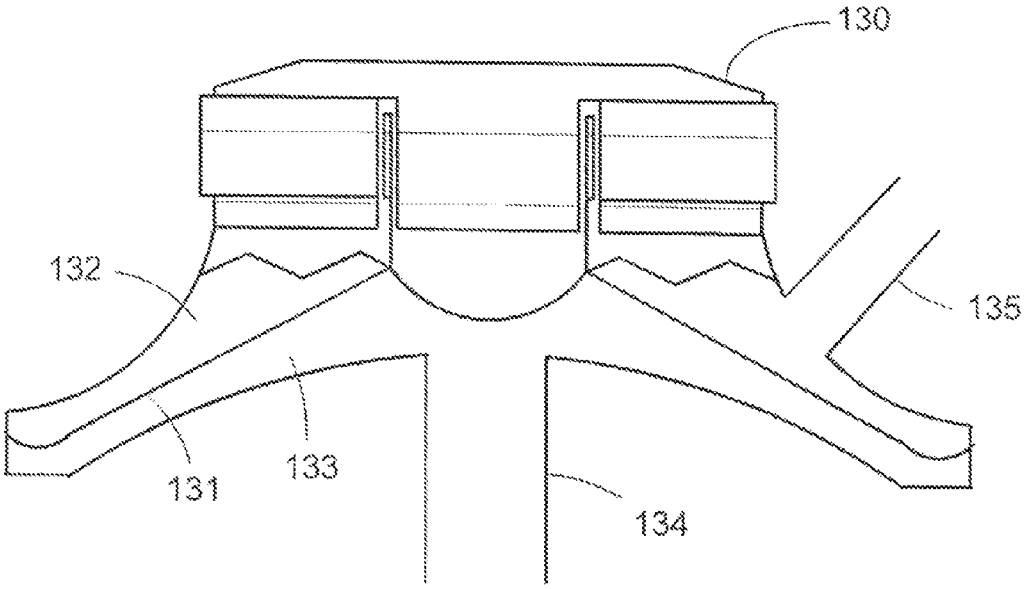
FIG. 13 shows a cross section of a loudspeaker assembly with front and rear Helmholtz chambers in which volumes associated with the Helmholtz chambers are approaching zero.

In some embodiments according to the present invention there may be little or no value in giving any volume to the chambers of the Helmholtz resonators. The volume may be substantially zero other than allowing for cone excursion or as close to zero as is practical. FIG. 13 shows how a "zero volume" loudspeaker assembly 130 may be constructed according to the present invention. In FIG. 13, cone 131 separates rear Helmholtz resonator chamber 132 from front Helmholtz resonator chamber 133. Chambers 132, 133 are vented by vent ducts 134 and 135 respectively. It may be seen that after allowing for cone excursion remaining enclosed air volumes associated with chambers 132, 133 are very small or close to zero.

Finally it is to be understood that various alterations, modifications and/or additions may be introduced into the constructions and arrangements of parts previously described without departing from the spirit or ambit of the invention.

The invention claimed is:

1. A loudspeaker assembly forming part of a loudspeaker system having an infinite baffle, said assembly comprising: a driver including a cone and a basket; and at least one Helmholtz resonator including a chamber and a vent duct communicating with said chamber and adapted to pass through said infinite baffle, wherein said chamber is formed by said cone with air trapped therein with said vent passing through the infinite baffle, wherein said chamber is arranged to tune air trapped between said cone and the infinite baffle, and wherein said chamber is dimensioned to provide a tuned frequency well above an operating band associated with said driver.

2. The loudspeaker assembly according to claim 1, wherein volume of said chamber is miniature relative to a chamber that is dimensioned to provide a tuned frequency within or close to said operating band associated with said driver.

3. The loudspeaker assembly according to claim 1, wherein cross sectional area of said vent duct is set to minimize air noise in said vent duct.

4. The loudspeaker assembly according to claim 1, wherein length of said vent duct is set to control low frequency extension.

5. The loudspeaker assembly according to claim 1, including two Helmholtz resonators wherein one resonator is positioned on each side of said driver.

6. The loudspeaker assembly according to claim 1 adapted for use in a motor vehicle, wherein said infinite baffle includes a perimeter of a passenger compartment of said vehicle and said vent duct is adapted to pass through said perimeter.

7. The loudspeaker assembly according to claim 6, wherein said infinite baffle includes an outer skin of said vehicle and said duct is adapted to pass through said outer skin.

8. The loudspeaker assembly according to claim 7, wherein said duct is adapted to pass through an existing opening in said skin such as a ventilation port.

9. The loudspeaker assembly according to claim 1, wherein frequency response of said loudspeaker system is rolled off at or near a top end of said operating band by means other than a Helmholtz resonator.

10. The loudspeaker assembly according to claim 1, wherein the chamber of at least one Helmholtz resonator approaches zero volume except for air trapped in an excursion range associated with said cone.

11. A loudspeaker system including a loudspeaker assembly according to claim 1.

12. The loudspeaker assembly of claim 1, wherein said basket includes a substantially continuous barrier and said resonator includes a rear chamber formed by said barrier and said cone to trap air behind said cone, said vent duct communicating with said rear chamber via said basket.

13. The loudspeaker assembly of claim 12, further comprising a second barrier for trapping air in front of said cone in a front chamber formed by said second barrier and said cone, said front chamber being vented by a second vent duct in said second barrier.

14. The loudspeaker assembly of claim 1, wherein the chamber of at least one Helmholtz resonator approaches zero volume except for air trapped in an excursion range associated with said cone.

15. The loudspeaker assembly of claim 1, wherein said driver includes a substantially continuous barrier and said resonator includes a front chamber formed by said barrier and said cone for trapping air in front of said cone, said vent duct communicating with said front chamber via said continuous barrier.

16. A method of tuning a loudspeaker assembly forming part of a loudspeaker system having an infinite baffle, said assembly including a driver having a cone and a basket, and at least one Helmholtz resonator having a chamber and a vent duct communicating with said chamber and adapted to pass through said infinite baffle, said method comprising: forming said chamber by said cone with air trapped therein, said chamber being arranged to tune air trapped between said cone and said infinite baffle, the vent duct passing through the infinite baffle, and dimensioning said chamber to provide a tuned frequency well above an operating band associated with said driver.

17. The method of tuning a loudspeaker assembly according to claim 16, wherein volume of said chamber is miniature relative to a chamber that is dimensioned to provide a tuned frequency within or close to said operating band associated with said driver.

18. The method of tuning a loudspeaker assembly according to claim 16, including setting cross sectional area of said vent duct to minimize air noise in said vent duct.

19. The method of tuning a loudspeaker assembly according to claim 16, including setting length of said vent duct to control low frequency extension.

* * * * *